United States Patent [19]

Mohr et al.

[11] Patent Number: 4,733,614

[45] Date of Patent: Mar. 29, 1988

[54] CONTINUOUSLY ADVANCING MACHINE FOR WORKS ON A RAILWAY TRACK

[75] Inventors: Gérard Mohr, Forbach; Frédéric Lorscheider, Bening les Saint Avold, both of France

[73] Assignee: Societe Anonyme styled: Framafer, France

[21] Appl. No.: 698,116

[22] Filed: Feb. 4, 1985

[30] Foreign Application Priority Data

Feb. 6, 1984 [FR] France ..... 84 01771

[51] Int. Cl.[4] ..... E01B 27/17

[52] U.S. Cl. ..... 104/7.1; 104/12; 74/110

[58] Field of Search ..... 104/2, 7 R, 7 B, 12; 188/378, 379; 74/110; 212/146, 198; 901/48

[56] References Cited

U.S. PATENT DOCUMENTS

| | | | |
|---|---|---|---|
| 3,322,379 | 5/1967 | Flannelly | 188/378 X |
| 3,687,081 | 8/1972 | Plasser et al. | 104/12 |
| 3,696,651 | 10/1972 | Harrison | 901/48 X |
| 4,101,009 | 7/1978 | Hehl et al. | 188/379 |
| 4,360,087 | 11/1982 | Curwen | 188/379 |
| 4,409,901 | 10/1983 | Hark | 104/7 B |
| 4,502,389 | 3/1985 | Theurer et al. | 104/12 |
| 4,534,295 | 8/1985 | Theurer | 104/7 B |

FOREIGN PATENT DOCUMENTS

| | | | |
|---|---|---|---|
| 1454379 | 8/1966 | France . | |
| 2314967 | 1/1977 | France . | |
| 2126635 | 3/1984 | United Kingdom | 104/7 B |

OTHER PUBLICATIONS

"Counterweighted Print Head Drive", *IBM Technical Disclosure Bulletin*, vol. 25, No. 9, 2-1983, Blaskovic et al.

*Primary Examiner*—Robert B. Reeves
*Assistant Examiner*—Scott H. Werny
*Attorney, Agent, or Firm*—Weingarten, Schurgin, Gagnebin & Hayes

[57] ABSTRACT

The present invention relates to a continuously advancing machine for works on a railway track, comprising a main chassis mounted on bogies and provided with a mobile chassis supported working members such as ballast tamping and track lifting/shifting units. The chassis may move along the main chassis under the action of a chain driven by a motor so as to advance, during the works, step by step with respect to the track while the machine progresses continuously. The reactions of inertia are compensated by a mobile counterweight coupled to the chain so as to execute movements parallel to those of the mobile chassis but in opposite direction, the respective quantities of movement of the counterweight and of the mobile chassis including the working members being equal and opposite.

9 Claims, 6 Drawing Figures

1
37
39
38
40
41
42
31b
36
34-35
28
26
27
31a
29
30
25
17
20
14
13
21
15
23
18
3
4

CONTINUOUSLY ADVANCING MACHINE FOR WORKS ON A RAILWAY TRACK

FIELD OF THE INVENTION

The present invention relates to a continuously advancing machine for works on a railway track, comprising a main chassis provided with members for rolling on the track and an auxiliary chassis supporting working members such as ballast tamping and track lifting/shifting units, the latter chassis being mobile and being adapted to move in translation along the main chassis under the action of drive means so as to advance, during the works, step by step with respect to the track, while the machine progresses continuously.

BACKGROUND OF THE INVENTION

A machine of this type is characterized, in operation, by a continuous advance of the main chassis on which is superposed a discontinuous advance of the mobile chassis supporting the working members. This latter must, in fact, particularly in the case of a track tamping machine, start up, brake and stop at each work cycle, over a relatively short path of displacement determined for example by a gap of 50 to 60 cm between the ties of the track.

Railway track tamping machines designed to this end are already known, in which the mobile chassis bearing the tamping and lifting/shifting members is composed of a chassis resting at the rear on an axle circulating on the rails between the rolling members of the main chassis of the tamping machine. This chassis is provided in its front part with two drawbars sliding with respect to the main chassis in appropriate guiding devices. The mobile chassis is accelerated and braked at each work cycle by a longitudinal jack, fast at one end with the mobile chassis and at the other end with the main chassis of the tamping machine.

A tamping machine designed according to this principle makes it possible to obtain a substantial increase in the operating performance with respect to tamping machines in which the working members are fixed with respect to the main chassis and therefore require, for their displacement from tie to tie, the acceleration and braking of the whole of the machine.

The continuously advancing tamping machines make it possible, in the phase of displacement of the working members from tie to tie, to be free of the conditions of wheel/rail adherence and, consequently, considerably to reduce the duration of this phase, since the efforts of acceleration or of deceleration of the working members are no longer to be transmitted in the form of driving torques acting on the wheels of the machine circulating on the rails. The systems of translation of the working units, characterizing this type of tamping machine, in fact enable much greater efforts of traction and of braking to be imparted to the working units.

However, a problem peculiar to this type of continuously advancing tamping machine resides in the compromise that must be found between the increase in output theoretically rendered possible by the principle set forth hereinabove of a chassis supporting the working members in relative movement with respect to the main chassis of the machine, and the comfort of the driving personnel who are in the cabs fast with the main chassis.

The accelerations and decelerations of the mobile chassis supporting the working members which appear at each work cycle lead, taking into account the appreciable weight of this mobile chassis, to longitudinal inertia reactions, with repercussions on the main chassis of the tamping machine and considerably shaking the drivers in the cabs at the beginning and end of the phase of displacement. The resulting discomfort is all the greater as it is desired to increase the output of the tamping machine further by increasing the speed of displacement of the mobile chassis. Another effect of these reactions of inertia is manifested in a loss of adherence of the main chassis rolling on the rails at the moment when they appear. In practice, this requires giving the main chassis as high as possible an adherent driving load and therefore leads to higher costs in driving the machine.

SUMMARY OF THE INVENTION

It is an object of the present invention to provide a continuously advancing machine of the type described hereinabove, for which the reactions of inertia generated by the discontinuous displacements of the working members are eliminated, so that the increase in operating performances is no longer limited by an increasing discomfort of the driving personnel.

The invention resides in the fact that a machine of the type in question further comprises a mobile counterweight which is coupled to the drive means of the mobile chassis so as to execute movements of translation parallel to those of the mobile chassis but in opposite direction, the respective quantities of movement of the counterweight and of the mobile chassis including its working members being equal and opposite. In other words, the quantities of movement vectors of these mobile elements are anti-parallel.

The reactions of inertia of the mobile chassis and of the mobile counterweight, equal and opposite, are permanently annulled, thus removing any sensation of discomfort for the driving personnel in the cab. The output of the machine may consequently be increased by reduction of the time of step by step advance of the mobile chassis and its working members.

The respective centers of gravity of the counterweight and of the mobile chassis including the working members should move along parallel straight lines which are as close as possible, in order to minimize the pitching torques exerted on the main chassis.

In the most simple case, the counterweight will be given a mass equal to the total mass of the mobile chassis and of the members that it supports, its speed of translation being equal in modulus to that of the mobile chassis. With a view to reducing the total mass of the machine, the counterweight may also be given a mass lower than the total mass of the mobile chassis and the members that it supports; its speed of translation must then be greater in modulus than that of the mobile chassis, the moduli of the speeds being inversely proportional to the masses.

The counterweight and the mobile chassis may be actuated in translation by a common driving means and be coupled together by a mechanical coupling means. In an embodiment relative to the case of the mobile chassis, including the members that is supports, and the counterweight having an equal mass, this coupling means may be constituted by a chain driven by a common motor and forming a closed loop with two sides parallel to the direction of displacement of the mobile chassis and of the counterweight, each of these latter being mechanically coupled to one of said sides respectively.

The counterweight and the mobile chassis may also be actuated in translation by distinct driving means and be coupled by synchronization means. These driving means are advantageously hydraulic actuating members coupled by electro-hydraulic synchronization means.

BRIEF DESCRIPTION OF THE DRAWINGS

The invention will be more readily understood on reading the following description with reference to the accompanying drawings, in which.

DETAILED DESCRIPTION OF THE PREFERRED EMBODIMENTS

Figure 1:
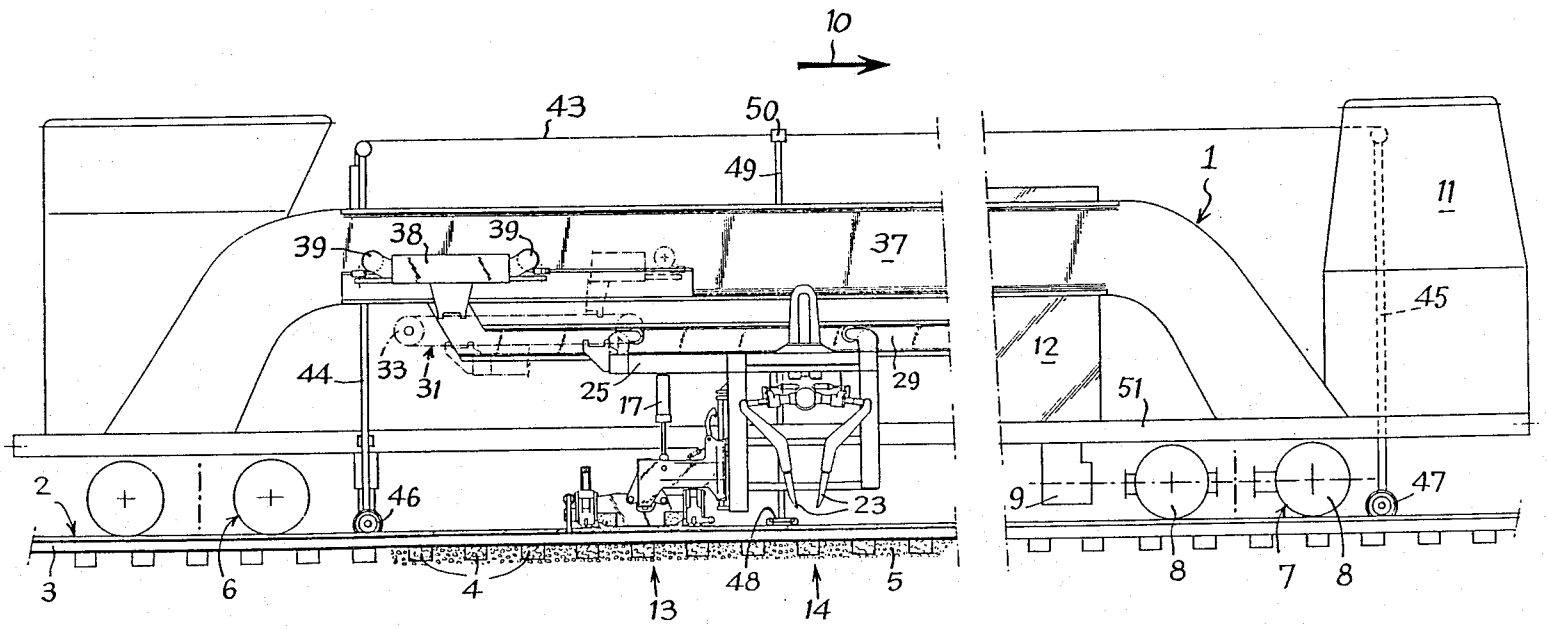
FIG. 1 schematically shows a machine according to the invention in side elevation.
Figure 2:
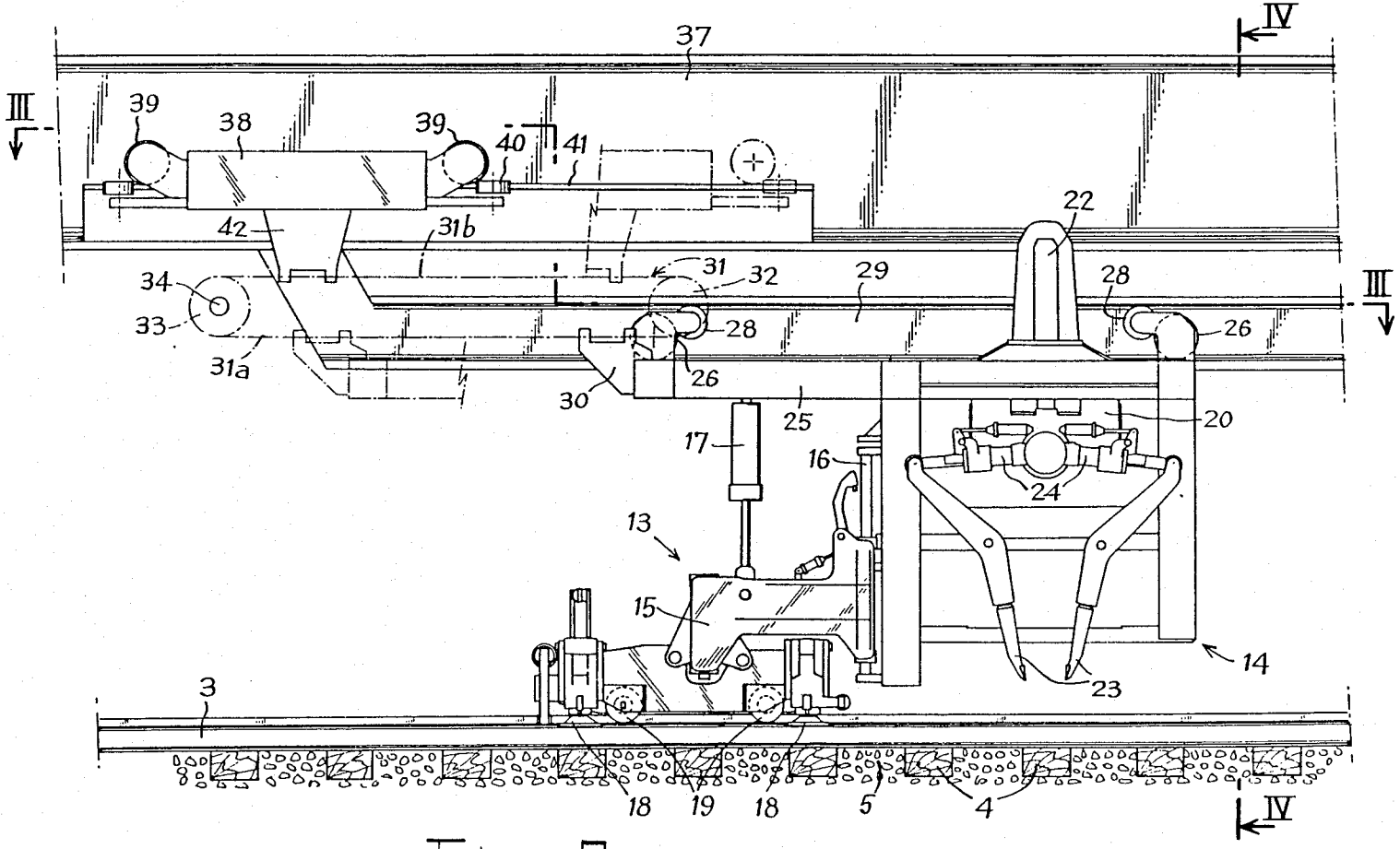
FIG. 2 show, on a larger scale, that part of the object of FIG. 1 where the working members are located.
Figure 3:
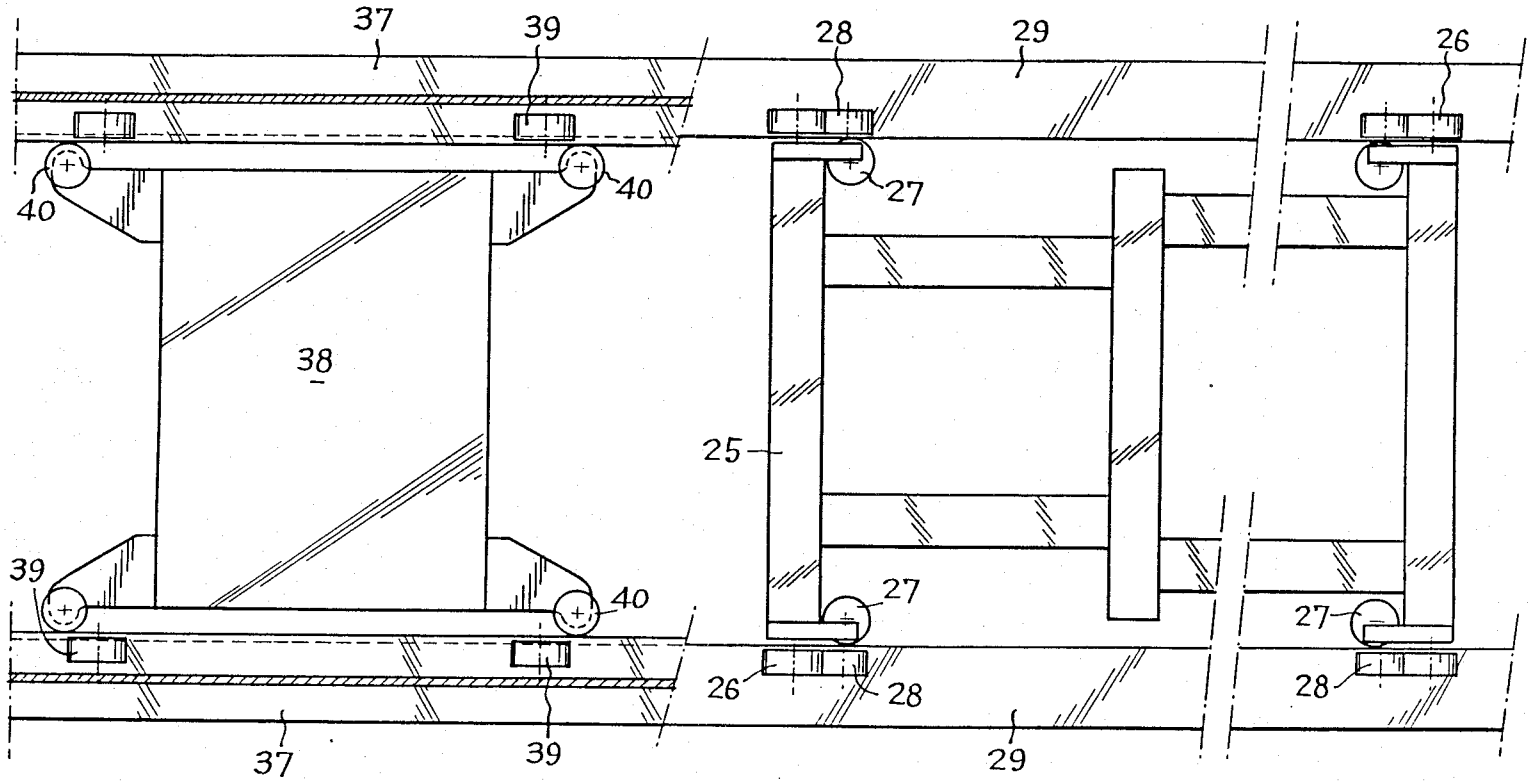
FIGS. 3 and 4 respectively show sections along lines III—III and IV—IV of the object of FIG. 2. For clarity of the drawing, the working members have not been shown in FIG. 3.
Figure 4:
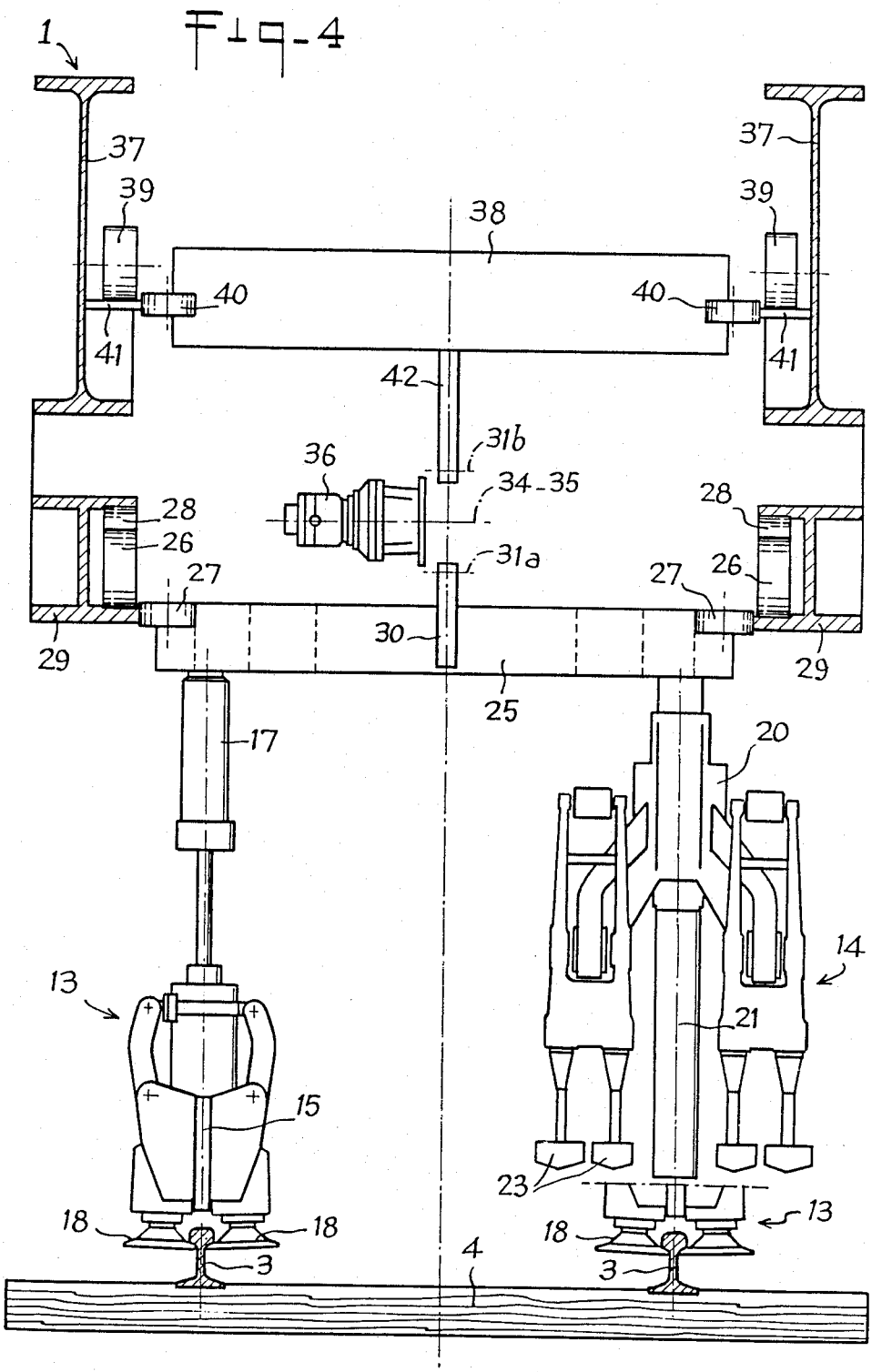

Referring now to the drawings, the machine shown in FIG. 1 comprises a main chassis 1 comprising a platform 51 and two strong sole bars 37, and resting on the track 2, constituted by rails 3 and ties 4 on a bed of ballast 5, via bogies 6, 7. The wheels 8 of bogie 7 are coupled to a drive motor 9 which advances the machine in the direction indicated by arrow 10 during the work periods.

The machine further comprises, in the front, a driver's cab 11 and an energy unit 12 supplying in particular the motor 9 and the working members.

These latter comprise a pair of lifting-shifting units 13 (one per line of rails 3) and a pair of tamping units 14 (likewise one per line of rails); in a variant embodiment, as shown, one tamping unit only may be provided, capable of moving transversely from one line of rails to the other.

Each lifting-shifting group 13 comprises a chassis 15 adapted to slide vertically along a column 16 under the action of a jack 17 to lift a line of rails gripped by two pairs of horizontal discs 18 borne by the chassis 15, and to pivot horizontally about this column under the action of another jack in order to shift the line of rails transversely via vertical discs 19 likewise borne by the chassis 15.

Each tamping unit 14 comprises a chassis 20 adapted to slide vertically along a column 21 under the action of a jack 22 and bearing a pair of vibratory tamping tools 23 actuated by jacks 24, which may penetrate in the ballast 5 on either side of a tie 4.

The working members 13, 14 are fixed beneath a mobile chassis 25 adapted to move, driving them along the main chassis 1, where it is supported by four vertical rollers 26 and guided by four horizontal rollers 27. In addition, four other vertical rollers 28 take up the upwardly directed efforts which may be exerted on the mobile chassis 25. The rollers 26, 27, 28 cooperate with two side elements 29 belonging to the main chassis 1 and extending beneath the sole bars 37.

The mobile chassis 25 is coupled by a driver 30 to the lower side 31*a* of an endless chain 31 which extends horizontally in the median plane of the main chassis 1 between two transmission gear wheels 32, 33 with horizontal pins 34, 35 fixed with respect to the main chassis. One of these gear wheels is provided with a hydraulic gear down motor unit 36 for drive in rotation.

The operations of lifting-shifting of the track 2, intended to eliminate the defects in alignment that the track may present, are controlled by a leveling unit with which the machine is equipped, which comprises a wire 43 stretched between the tops of two vertical rods 44, 45 widely spaced apart, resting on the track by small wheels 46, 47. Between the latter there is disposed a track sensing carriage 48 supporting a vertical rod 49 at the top of which is placed a displacement sensor 50 which, as a function of the position that it takes with respect to the wire 43, controls by leveling the lifting-shifting units 13. Another similar assembly ensures lateral control relative to the corrections of layout of the track.

Between the sole bars 37 of the main chassis 1 there is further guided, by rails 41 fast with said sole bars, a mass 38 forming counterweight with respect to the mobile chassis 25 and its working members 13, 14. This counterweight may move in translation, supported by four vertical rollers 39, and guided by four horizontal rollers 40, along a rectilinear path parallel to the path of displacement of the mobile chassis 25. To this end, it is provided with a driver 42 in mesh with the upper side 31*b* of the chain 31. The counterweight 38, including its annexes, presents a mass equal to the working assembly 25, 13, 14 and its annexes. The distances covered by these mobile elements are constantly equal, with equal speeds but in opposite directions thanks to the synchronization of their movements effected by the chain 31.

In operation, all the movements of longitudinal translation communicated to the working assembly by the gear down motor unit 36, via the chain 31 by its lower side 31*a*, determine movements of longitudinal translation which are equal and in phase opposition for the counterweight 38, so that the efforts of inertia generated by the step by step displacement of the working units are annulled by compensation. In this way, the movements of the working units, even the most sudden, which correspond to their rapid passage from a tie 4 to the following tie between two tamping operations, cause no detrimental shaking of the main chassis 1 and the whole of the machine.

Figure 5:
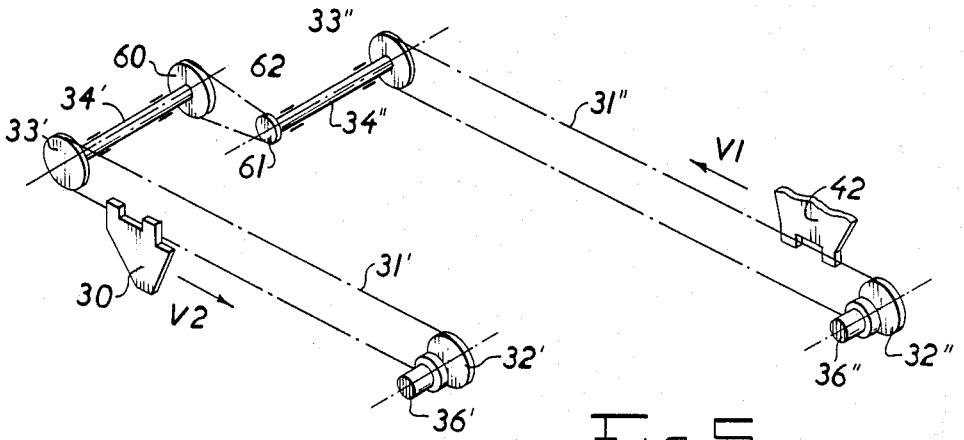
FIG. 5 illustrates a perspective of the mechanical synchronization of two working hydraulic motors respectively driving the counter weight and the mobile chassis.
Figure 6:
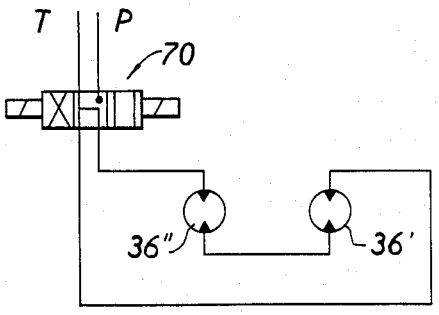
FIG. 6 illustrates by way of a schematic an electro-mechanical synchronization for said two motors.

In a variant embodiment, two independent systems for drive in translation may be provided, one for the mobile chassis 25 and the other for the counterweight 38, each of them comprising for example an endless chain 31′, 31″ (FIG. 5) actuated by a hydraulic motor 36′, 36″ (FIG. 5) as described hereinabove, or a horizontal hydraulic jack connected to the main chassis. The synchronization of the contrary movements is in that case no longer effected mechanically, but electro-hydraulically; to this end, two potentiometric sensors may be provided, measuring the distance covered respectively by the mobile chassis and by the counterweight, which, according to a common speed control law, vary the output of the two motors 36′, 36″ (FIGS. 5, 6) or hydraulic jacks for translation by means of an electro-hydraulic valve 70 (FIG. 6) with proportional action.

In another embodiment of the invention, the quantity of movement of compensation, equal and opposite to that of the mobile chassis, is effected with the aid of a counterweight of mass lower than that of the mobile chassis, but animated by a speed greater than that of the latter, the ratio between the masses being equal to the inverse ratio of the respective speeds. This embodiment presents the advantage of reducing the weights coming into play. However, it requires different strokes for the mobile chassis and for the counterweight. The systems of synchronization must here ensure a ratio of the speeds different from the unit corresponding for example to a ratio of gears 60, 61 (FIG. 5), cubic capacities of drive motors or sections of different hydraulic jacks.

What is claimed is:

1. A continuously advancing machine for works on a railway track, comprising:

a main chassis provided with members for rolling on the track and an auxilliary mobile chassis supporting working members such as ballast tamping and track lifting/shifting units, the mobile chassis being mobile and being adapted to move in translation along the main chassis under the action of drive means so as to advance, during the works, step by step with respect to the track while the machine progresses continuously, a mobile counterweight which is coupled to the drive means of the mobile chassis so as to execute movements of translation parallel to those of the mobile chassis but in opposite direction, the respective quantities of movement of the counterweight and of the mobile chassis including its working members being equal and opposite, the counterweight having a mass equal to the total mass of the mobile chassis and of the members that it supports, and its speed of translation is equal in modulus to that of the mobile chassis.

2. The machine of claim 1, wherein the counterweight and the mobile chassis are actuated in translation by a common drive means and are coupled together by a mechanical coupling means.

3. The machine of claim 2, wherein the mobile chassis, including the members that it supports, and the counterweight have an equal mass and the coupling means is a chain driven by a common motor and forming a closed loop with two sides parallel to the direction of displacement of the mobile chassis and of the counterweight, each of these latter being mechanically coupled to one of the said sides respectively.

4. The machine of claim 1, wherein the counterweight and the mobile chassis are actuated in translation by distinct drive means and are coupled by synchronization means.

5. The machine of claim 4, wherein the drive means are hydraulic actuation members and are coupled by electro-hydraulic synchronization means.

6. A continuously advancing machine for works on a railway track, comprising:

a main chassis provided with members for rolling on the track and an auxiliary mobile chassis supporting working members such as ballast tamping and track lifting/shifting units, the mobile chassis being mobile and being adapted to move in translation along the main chassis under the action of drive means so as to advance, during the works, step by step with respect to the track while the machine progresses continuously, a mobile counterweight which is coupled to the drive means of the mobile chassis so as to execute movements of translation parallel to those of the mobile chassis but in opposite direction, respective quantities of movement of the counterweight and of the mobile chassis including its working members being equal and opposite, the counterweight has a mass less than the total mass of the mobile chassis and the members that it supports, and its speed of translation is greater in modulus than that of the mobile chassis, the moduli of the speeds being inversely proportional to the masses.

7. The machine of claim 6, wherein the counterweight and the mobile chassis are actuated in translation by a common drive means and are coupled together by a mechanical coupling means.

8. The machine of claim 6, wherein the counterweight and the mobile chassis are actuated in translation by distinct drive means and are coupled by synchronization means.

9. The machine of claim 8, wherein the drive means are hydraulic actuation members and are coupled by electro-hydraulic synchronization means.

* * * * *